United States Patent [19]

Cunningham

[11] Patent Number: 4,936,595

[45] Date of Patent: Jun. 26, 1990

[54] CANOE TOTER

[76] Inventor: Brian J. Cunningham, 60 Summer St., Hanover, Mass. 02339

[21] Appl. No.: 303,538

[22] Filed: Jan. 27, 1989

[51] Int. Cl.[5] ..... B62B 1/04

[52] U.S. Cl. ..... 280/47.331; 114/344; 280/414.2

[58] Field of Search ..... 114/344; 280/47.331, 280/414.1, 414.2, 414.3; 248/172, 287

[56] References Cited

U.S. PATENT DOCUMENTS

| | | | |
|---|---|---|---|
| 2,361,951 | 11/1944 | Livermon | 114/344 |
| 2,437,736 | 3/1948 | Good | 114/344 |
| 2,551,040 | 5/1951 | Newell | 280/47.331 |
| 2,723,130 | 11/1955 | Andrews | 280/47.19 |
| 2,844,383 | 7/1958 | Deeter | 280/47.331 |
| 2,970,846 | 2/1961 | Boston | 280/40 |
| 3,068,024 | 12/1962 | Berliner | 280/47.331 X |
| 3,379,452 | 6/1966 | Torrisi | 280/63 |
| 3,445,018 | 5/1969 | Reagan | 280/47.331 X |
| 3,567,241 | 2/1969 | Foschino | 280/47.32 |
| 3,887,093 | 6/1975 | Howell | 114/344 X |
| 4,214,774 | 7/1980 | Kluge | 280/652 |
| 4,422,665 | 12/1983 | Hinnant | 114/344 X |
| 4,824,127 | 4/1989 | Stamm | 280/47.331 |

*Primary Examiner*—Charles A. Marmor
*Assistant Examiner*—Michael Mar
*Attorney, Agent, or Firm*—Wolf, Greenfield & Sacks

[57] ABSTRACT

Canoe toting apparatus which enables a single individual to manually transport a canoe or similar marine craft over reasonable distances comprises a pair of wheels rotatably mounted on opposite ends of an adjustable width axle and a adjustable-width gunwale clamp whcih extends parallel to the axle and is attached at each end to one of the axle ends by clamping rods. The rods are threaded and accept nuts which can be tightened against the gunwale clamp to secure the canoe against the axle. An optional keel guide, contoured for a conventional V-shaped keel, attaches to the top surface of the axle to accommodate canoes having keels.

10 Claims, 3 Drawing Sheets

CANOE TOTER

FIELD OF THE INVENTION

The present invention relates to the field of boat transportation, and more specifically, to a utility device for transporting a canoe or similar marine craft. The present invention provides a canoe toter which enables a single individual to manually transport a canoe over reasonable distances.

BACKGROUND OF THE INVENTION

A variety of apparatus are commercially available for transporting marine crafts of sizes ranging from kayaks to yachts. For medium to large boats, the apparatus usually consists of a trailer which serves as a means for both transporting and launching the boat. Such a device is disclosed in U.S. Pat. No. 4,422,665 issued to Hinnant. The device disclosed in the Hinnant patent is intended for towing behind a vehicule and was not meant for manual transport of the boat over an extended distance. Furthermore, the Hinnant device is designed to transport a medium sized boat and is, unfortunately, not adaptable to small marine vehicles.

Smaller marine vehicles, such as kayaks, canoes or small sail boats, do not require a trailer type vehicle because of the reduced size and weight of the craft For such smaller marine crafts, transportation racks, attachable to the roof of an automobile, are available for transporting the craft. Unfortunately, such rack type apparatus provide no assistance in launching the craft. Furthermore, with many of the smaller crafts, such as canoes and kayaks, the desired body of water is often remote from any roads or paths which are accessible to automobiles. Subsequently, the user must dismount the craft from the automobile and manually carry the craft the remaining distance. It is not uncommon for fish and game or sports enthusiasts to manually carry canoes a mile or more to the desired body of water. Unfortunately, it is often impractical and even dangerous for a lone individual to carry a canoe or other craft any distance greater than several hundred feet due to the considerable physical fatigue and stress which occur.

It is therefore an object of the present invention to provide canoe toter which enables a single user to manually transport a canoe or other small marine craft over extended distances.

A further object of the present invention is to provide a canoe toter which is strong, durable and able to withstand extended wear and abuse from the environment.

Yet another object of the present invention is to provide a canoe toter which is adaptable to a variety of canoe sizes and which itself can be reduced in size to facilitate ease of storage and transportation when not in use.

BRIEF SUMMARY OF THE INVENTION

The foregoing and other objects of the present invention are achieved with a canoe toter which enables a single individual to manually transport a canoe or other similar marine craft over reasonable distances.

According to one embodiment of the present invention, a canoe toter is comprised of a pair of wheels mounted on opposite ends of an adjustable length axle. A gunwale clamp, having an adjustable length, is mounted to the axle ends.

The width of the axle is adjustable to accommodate varying canoe sizes. The length of the gunwale clamp is also adjustable to the height of the canoe so that the clamp can apply pressure directly on the canoe gunwale, thereby holding the canoe securely against the axle. An optional keel guide, contoured to a conventional V shaped keel, attaches to the axle to accomodate keeled canoes. In operation, the toter is mounted to the canoe slightly off center so that, with fishing or other gear stowed in the canoe, the canoe is approximately balanced over the toter axle. The user can then hold one end of the canoe and either pull or push the canoe and gear to the desired location. Large diameter wheels on the toter position the canoe to approximately hip height so that the canoe is easy to grasp.

The invention will be move fully understood from the detailed description set forth below, which should be read in conjunction with the accompanying drawings. The invention is defined in the claims appended at the end of the detailed description, which is offered by way of example only.

DETAILED DESCRIPTION OF THE PREFERRED EMBODIMENT

Figure 1:
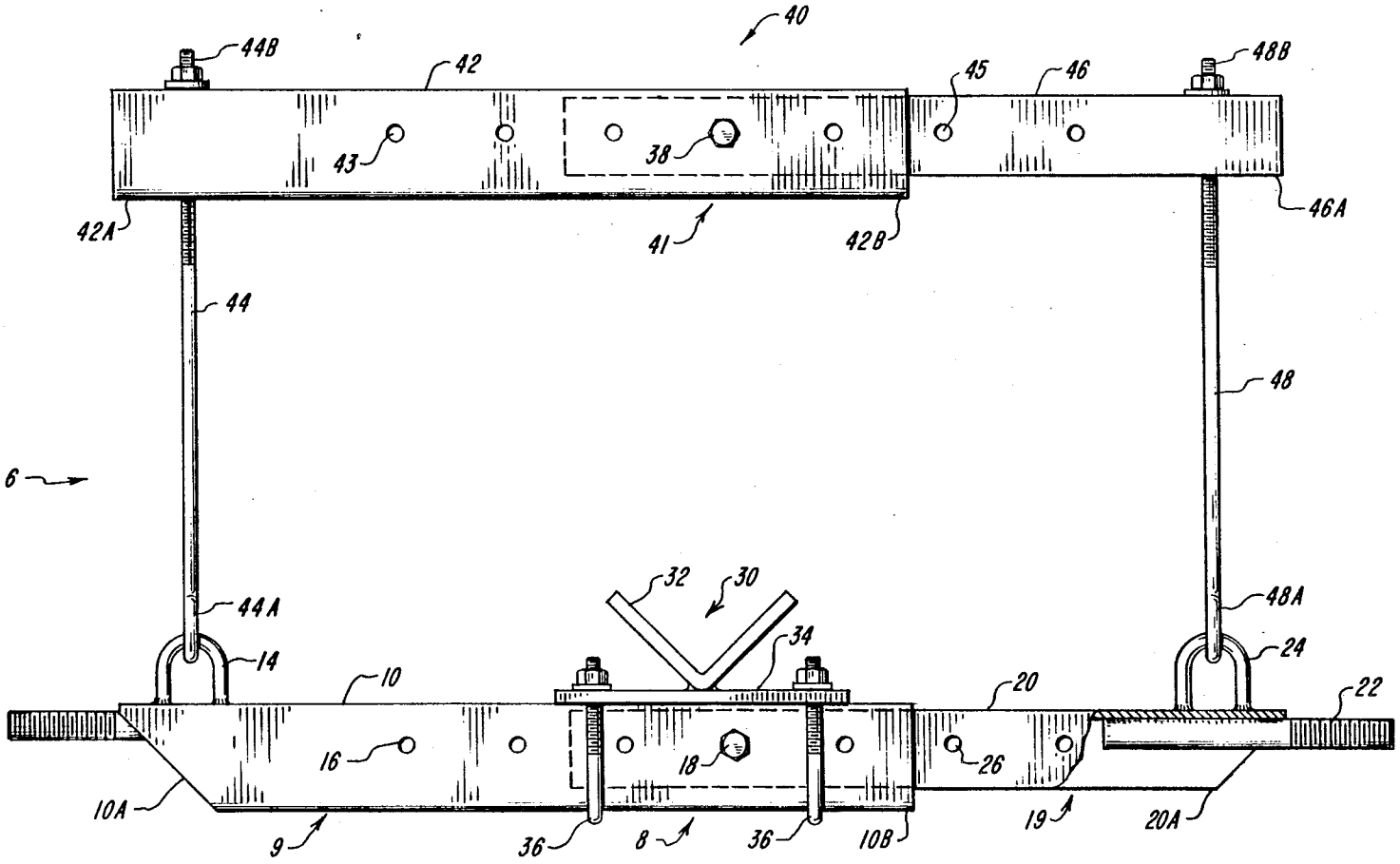
FIG. 1 is a plane front view of the canoe toter of the present invention.
Figure 3:
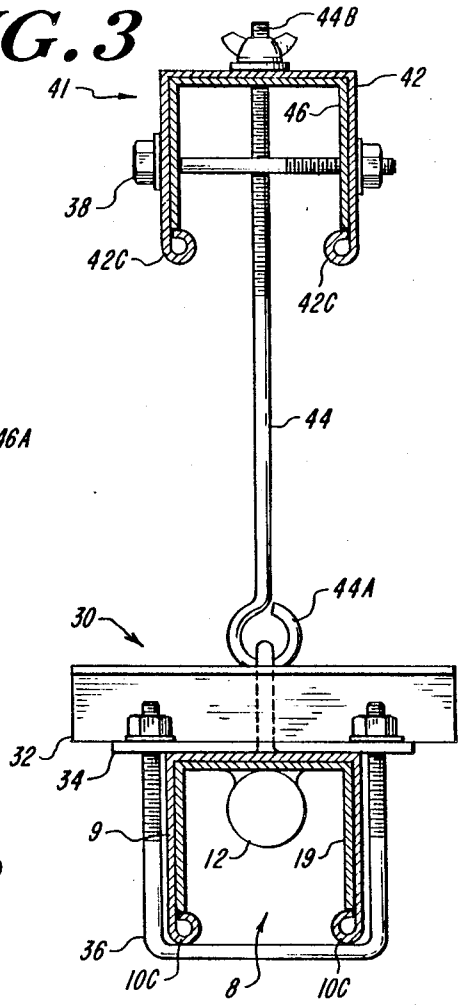
FIG. 3 is a cut away view of the canoe toter of FIG. 2 taken along line 3—3 in FIG. 2.
Figure 2:
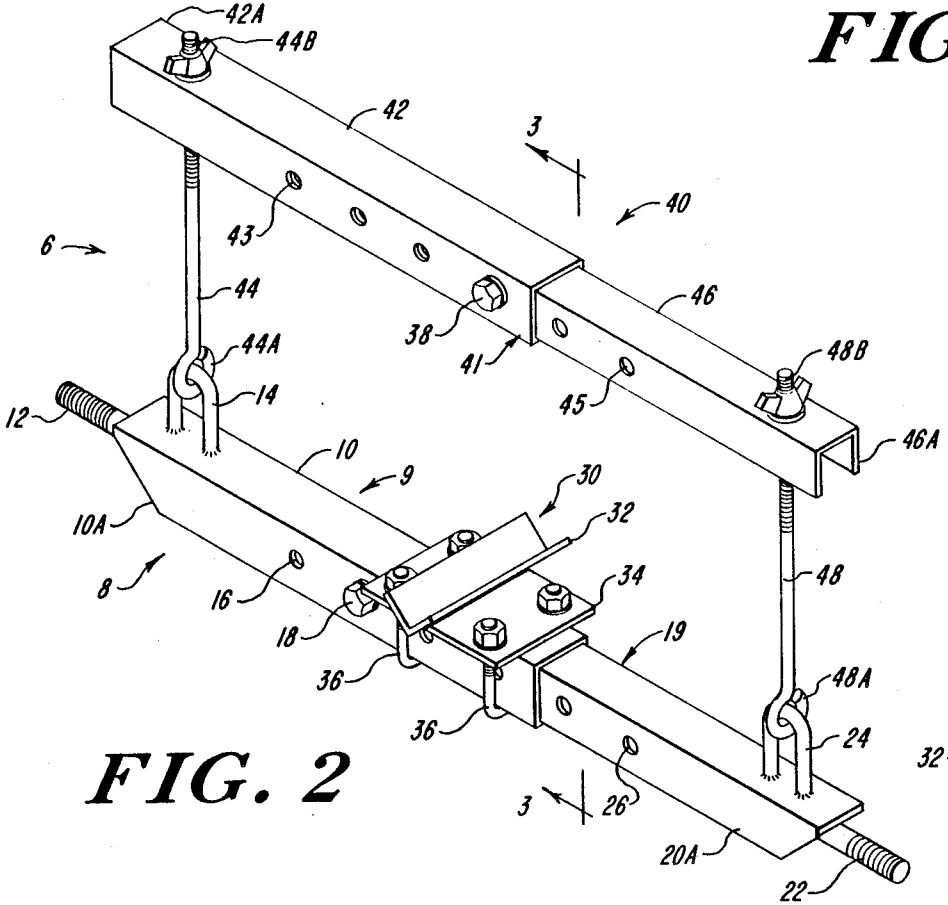
FIG. 2 is a plane perspective view of the canoe toter of FIG. 1.

Referring to the drawings, and in particular FIGS. 1–3, an illustrative embodiment of the canoe toter 6 is comprised of axle 8, wheels 51 and 52, and clamp 40.

In the preferred embodiment, axle 8 is comprised of outer axle member 9 and inner axle member 19. Outer axle member 9 is further comprised of box-beam 10, axle shaft 12 and U-bolt 14. Preferrably, box-beam 10 is comprised of metal formed into a three sided square beam having a wall thickness of approximately 3/32", side widths of 1½", and a length of approximately 36". The bottom edges 10C are bent back against the interior front and back surfaces of the box-beam 10 so as to form a ledge like structure along the interior length of both surfaces. Axle end 10A of box-beam 10 contains 45° cuts in the front and back surfaces of the box-beam, as shown in FIG. 1. An axle shaft 12 is attached to the top interior surface of box-beam 10. Preferrably, axle shaft 12 is comprised of a 3½" cylindrical shaft having an outer diameter of approximately ½" with a standard thread machined onto a 1" section of the exposed end of the shaft. U-bolt 14 is attached to the top surface of box-beam 10 approximately 1¾" from axle end 10A. U-bolt 14 has a diameter of approximately ⅜" and a height of approximately 1½". A plurality of adjustment holes 16 are bored through the front and back surfaces of box-beam 10. Adjustment holes 16 have a diameter of approximately 9/16" and are spaced approximately 5" apart along a straight line. In the preferred embodiment, all parts of outer axle member 9 are formed of milled steel and welded together.

Inner axle member 19, the symmetrical reflection of outer axle member 9, is similarly comprised of box-beam 20, axle shaft 22, and U-bolt 24. Inner axle member 19 is identical to outer axle member 9 except that the sides of box-beam 20 have dimensions of $1\frac{3}{8}''$ and the bottom edges box-beam 20 do not contain ledge like structure similar to bottom edges 10C of box-beam 10.

Axle 8 is formed by coaxially positioning inner axle member 19 within outer axle member 9. This is accomplished by inserting penetrating end 20B of box-beam 20, shown in phantom in FIG. 1, into receiving end 10B of box-beam 10 so that the bottom edges of box-beam 20 rest on bottom edges 10C of box-beam 10. Inner axle member 19 is disposed within outer axle member 9 so as to allow slidable movement of the inner axle member within the outer member, thereby enabling the aggregate length of axle 8 to be expanded or retracted as desired.

The length of axle 8 is fixed by inserting an adjustment bolt 18 within the axially aligned adjustment holes 16 and 26. Preferrably, adjustment bolt 18 is a standard hex-head bolt with a $1\frac{7}{8}''$ length, a $\frac{1}{2}''$ diameter and a standard thread. Adjustment bolt 18 is inserted through a standard lock washer, through adjustment hole 16 of box-beam 10, through adjustment hole 26 of box-beam 20 and secured in place by threading a lock washer and a $\frac{1}{2}''$ hex-head nut over the adjustment bolt, thereby fastly securing inner axle member 19 within outer axle member 9.

Clamp 40 is movably attached to axle 8, as shown in FIGS. 1–3. Clamp 40 is comprised of gunwale beam 41 and clamping rods 44 and 48.

Beam 41 is further comprised of outer beam member 42 and inner beam member 46. Outer beam member 42 is similar in shape to box-beam 10 of outer axle member 9. Outer beam member 42 is preferrably comprised of metal formed into a three sided square beam having a wall thickness of approximately 3/32", a length of approximately 26", and side widths of 1". Similar to bottom edges 10C of axle member 10, bottom edges 42C, are bent back against the interior front and back surfaces of the outer beam member 42 so as to form a ledge-like structure along the interior length of both surfaces. Approximately $1\frac{1}{2}''$ from exterior end 42A of outer beam member 42, a mounting hole 42D, having a 9/16" diameter, is bored into the top surface of outer beam member 42 for accepting threaded end 44B of positioning rod 44. A plurality of adjustment holes 43 are bored through the front and back surfaces of outer beam member 42. Preferrably, adjustment holes 43 have a diameter of approximately 9/16" and are spaced approximately 5" apart along a straight line. In the preferred embodiment, outer beam member 42 is formed of milled steel.

Inner beam member 46, the symmetrical reflection of outer beam member 42, is identical to outer beam member 42 except that the sides of inner beam member 46 have dimensions of or $\frac{7}{8}''$ and the bottom edges of inner beam member 46 do not contain a ledge-like structure similar to the bottom edges 42C of outer beam member 42.

The gunwale beam 41 of clamp 40 is formed by coaxially positioning inner beam member 46 within outer beam member 42. This is accomplished by inserting penetrating end 46B of inner beam member 46, shown in phantom in FIG. 1, into receiving end 42B of outer beam member 42 so that the bottom edges of inner beam member 46 rests on the bottom edges 42C of outer beam member 42. Inner beam member 46 is disposed within outer beam member 42 so as to allow slidable movement of the inner beam member within the outer beam member, thereby enabling the aggregate length of gunwale beam 41 to be expanded or retracted as desired.

The length of beam 41 is fixed by inserting an adjustment bolt 38 within the axially aligned adjustment holes 43 and 45. Preferrably, adjustment bolt 38 is a standard hex head bolt with a $1\frac{7}{8}''$ length, a $\frac{1}{2}''$ diameter and a standard thread. Adjustment bolt 38 is inserted through a standard lock washer, through adjustment hole 43 of outer beam member 42, through adjustment hole 45 of inner beam member 46 and secured in place by threading a lock washer and a $\frac{1}{2}''$ hex-head nut over the adjustment bolt, thereby securing inner beam member 46 within outer beam member 42.

Clamp 40 is movably mounted to axle 8 via clamping rods 44 and 48 which mechanically couple gunwale beam 41 to axle 8. In the preferred embodiment, clamping rods 44 and 48 are I-bolts having a 20" length, a $\frac{1}{2}''$ diameter and a standard thread machined onto a 13" section of the straight ends of the clamping rods. U-bolt 14 of outer axle member 9 penetrates eyelet 44A of clamping rod 44, pivotally coupling clamping rod 44 to outer axle member 9. Similarly, U-bolt 24 of inner axle member 19 penetrates eyelet 48A of clamping rod 48, pivotally coupling clamping rod 48 to inner axle member 19. Clamp 40 is completed by slidably mounting beam 41 over clamping rods 44 and 48. This is accomplished by inserting threaded end 44B of clamping rod 44 into mountable hole 42D of outer clamp member 42 and similarly inserting threaded end 48B of clamping rod 48 into mounting hole 46D of inner clamp member 46.

The vertical height of beam 41 is adjustable by sliding beam 41 along the clamping rods 44 and 48 until beam 41 rests on the canoe gunwale. Beam 41 is secured in place by threading a lock washer and $\frac{1}{2}''$ wing nut over threaded ends 44B and 48B so as to secure beam 41 against the canoe gunwales.

Figure 4:
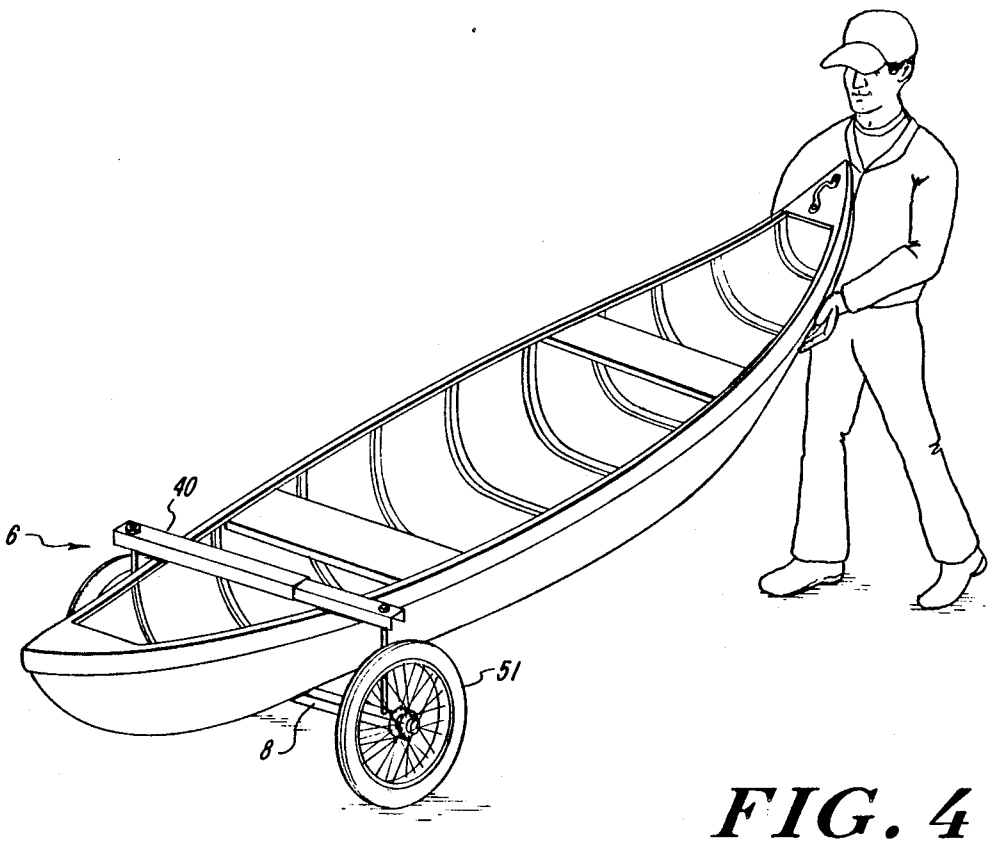
FIG. 4 is a perspective view of the canoe toter of the present invention illustrating its proper use.

A pair of conventional wheels 51 and 52, having a diameter of 10" or greater, are rotatably mounted to axle shaft 12 of outer axle member 9 and axle shaft 22 of inner axle member 19, as shown in FIG. 4. Preferrably wheels 51 and 52 are easily dismountable from axle 8 so as to facilitate ease of storage and transportation of canoe toter 6 when not in use.

A keel guide 30 is optionally attachable to axle 8. Keel guide 30 is comprised of V-shaped guide 32, guide base 34, and U-shaped screws 36. V-shaped guide 32, as shown in FIGS. 1–3, is approximately 5–7" in length and has a wall thickness of approximately 3/32". V-shaped guide 32 is attached to guide base 34 as shown in FIG. 2. The rectangularly shaped guide base 34 contains, at each corner, a bore for insertion of U-shaped screws 36. Preferrably, U-shaped screws 36 have a diameter of approximately $\frac{1}{2}''$ and a standard thread at each end.

Keel guide 30 is attached to axle 8 by placing guide plate 34 adjacent the top surface of outer axle member 9. U-shaped screw 36 are then inserted through the bottom of guide plate 34 so that their threaded ends project upward from guide plate 34. Keel guide 30 is then secured in place by fastening each end of U-shaped screws 36 with a standard lock washer and hex-head nut.

To avoid frictional damage to the canoe by surface contact with canoe toter 6, synthetic or natural rubber padding may be attached to the top surface of axle 8, the inner surface of V shaped guide 32 and the bottom edges of clamping surface 41.

The assembly and use of canoe toter 6 is as follows. Axle 8 is formed by inserting inner axle member 19 into outer axle member 9, and adjusting the aggregate length of axle 8 to the width of the canoe. Adjustment screw 18 is then inserted into both outer axle member 9 and inner axle member 19 and secured in place, thereby fixing the length of axle 8. Wheels 51 and 52 are then rotatably mounted onto axle shafts 12 and 22 of axle 8. The keel of one end of the canoe is positioned adjacent the top surface of axle 8 or within the V-shaped guide 30 attached to axle 8.

Gunwale beam 41 is formed by inserting inner beam member 46 into outer beam member 42 and adjusting the aggregate length of the gunwale beam to correspond with the aggregate length of axle 8. Adjustment bolt 38 is then inserted into both outer beam member 42 and inner beam member 46 and secured in place, thereby fixing the length of gunwale beam 41. Beam 41 is then slidably positioned over clamping rods 44 and 48 so that it rests on the gunwale of the canoe. Beam 41 is fixed in place by threading a wing nut over the threaded ends 44B and 48B of clamping rods 44 and 48, respectively.

The user of canoe toter 6 may then stow his gear and other equipment in the interior of the canoe. As shown in FIG. 4, the user then grasps the opposite end of the canoe and pushes or pulls the craft to the desired body of water.

Having thus described one particular embodiment, various alterations, modifications and improvements will readily occur to those skilled in the art. Such alternations, modifications and improvements as are made obvious by this disclosure are intended to be part of this disclosure though not expressly stated herein, and are intended to be within the spirit and scope of the invention. Accordingly, the foregoing description is intended to be exemplary only and not limiting. The invention is limited only as defined in the following claims and equivalence thereto.

What is claimed:

1. Apparatus for transporting a canoe or similar marine craft having gunwales, said apparatus comprising:

an axle, said axle having an adjustable width to accommodate marine craft of varying widths, said axle having a first and a second end and a top surface against which said marine craft rests;

a pair of wheels, one of said pair of wheels being perpendicularly and rotatably mounted on said first axle end and the other of said pair of wheels being perpendicularly and rotatably mounted on said second axle end;

a gunwale clamp beam having an adjustable length and extending parallel to said axle for engaging said gunwales, said gunwale clamp having a first end and a second end;

a pair of rigid clamping rods;

first bolt means for pivotally attaching a first of said pair of clamping rods to said first axle end so that said first of said pair of clamping rods is movable in two dimensions with respect to said axle;

second bolt means for pivotally attaching a second of said pair of clamping rods to said second axle and so that said second of said pair of clamping rods is movable in two dimensions with respect to said axle, said first and second clamping rods extending through said first and second gunwale clamp ends respectively; and means for adjustable securing said first clamping rod to said first gunwale clamp end and said second clamping rod to said second gunwale clamp and so that the height of said clamp beam from said axle can be adjusted to accommodate marine crafts of varying heights.

2. The canoe transporting apparatus of claim 1 further comprising a guide member attachable adjacent said axle top surface for accommodating the keel of a canoe or similar marine craft.

3. The canoe transporting apparatus of claim 2 whereby said guide member has a substantially V-shaped guide for receiving the keel of a canoe or similar marine craft.

4. Apparatus for transporting a canoe or similar marine craft comprising:

an axle, having an outer axle member and an inner axle member, said inner axle member having the same cross-sectional shape as said outer axle member but with a smaller cross-sectional size so that said inner axle member slides within said outer axle member forming a telescoping axle with length adjustable over a predetermined range, said axle having a first and a second end and a top surface against which said marine craft or canoe rests;

a pair of wheels, one of said pair of wheels being perpendicularly and rotatably mounted on said first axle end and the other of said pair of wheels being perpendicularly and rotatably mounted on said second axle end;

a gunwale clamp having a first end, a second end, an outer clamp member and an inner clamp member, said inner clamp member having the same cross-sectional shape as said outer clamp member but with a smaller cross-sectional size so that said inner clamp member slides within said outer clamp member forming a telescoping clamp with length adjustable over a predetermined range; and a pair of threaded clamping rods pivotally mounted to said axle, one of said pair of rods being attached to said first axle end and extending through said first gunwale clamp end and the other of said pair of rods being attached to said second axle end and extending through said second gunwale clamp end, said clamping rods having clamping nuts threaded thereon, which nuts bear against said gunwale clamp and cause said gunwale clamp to bear against the gunwales of said marine craft

5. The canoe transporting apparatus of claim 4 further comprising a guide member attachable adjacent said axle top surface for accommodating the keel of a canoe or similar marine craft.

6. The canoe transporting apparatus of claim 5 whereby said guide member has a substantially V-shaped guide for receiving the keel of a canoe or similar marine craft.

7. The canoe transporting apparatus of claim 6 wherein said axle can be fixed at a predetermined width by means of a bolt passing through said inner axle member and said outer axle member.

8. The canoe transporting apparatus of claim 7 wherein said gunwale clamp can be fixed at a predetermined width by means of a bolt passing through said inner clamp member and said outer clamp member.

9. The canoe transporting apparatus of claim 8 wherein said clamping rods are attached to said first and said second axle ends by means of interlinked loops

10. The canoe transporting apparatus of claim 9 wherein said axle top surface, said gunwale clamp and said keel guide are covered with a resilient material to reduce abrasion to a marine craft carried by said transporting apparatus.

* * * * *